US006155140A

United States Patent [19]

Tsai

[11] Patent Number: 6,155,140

[45] Date of Patent: Dec. 5, 2000

[54] RATCHET WRENCH

[76] Inventor: Tzen Chang Tsai, P.O. Box 63-99, Taichung, Taiwan, 406

[21] Appl. No.: 09/392,545

[22] Filed: Sep. 9, 1999

[51] Int. Cl.[7] ..... B25B 13/46

[52] U.S. Cl. ..... 81/61; 81/58.2

[58] Field of Search ..... 81/61, 58.2, 180.1, 81/185.1, DIG. 11, 177.85

[56] References Cited

U.S. PATENT DOCUMENTS

| | | | |
|---|---|---|---|
| 1,060,185 | 4/1913 | Hitt | 81/58.2 |
| 1,523,022 | 1/1925 | Larson | 81/177.85 |
| 1,890,213 | 12/1932 | Cameron et al. | 81/58.2 |
| 2,578,410 | 12/1951 | Filiatreault | 81/58.2 |
| 2,693,123 | 11/1954 | Fish | 81/58.2 |
| 2,699,082 | 1/1955 | Viets | 81/58.2 |
| 3,175,434 | 3/1965 | Bergquist | 81/58.2 |
| 4,562,757 | 1/1986 | Furey | 81/63 |
| 4,602,534 | 7/1986 | Moetteli | 81/177.85 |

FOREIGN PATENT DOCUMENTS

| | | | |
|---|---|---|---|
| 26386 | 12/1908 | United Kingdom | 81/58.2 |
| 6225 | 3/1909 | United Kingdom | 81/58.2 |
| 18561 | 8/1909 | United Kingdom | 812/58.2 |

*Primary Examiner*—James G. Smith
*Assistant Examiner*—Hadi Shakeri

[57] ABSTRACT

A ratchet wrench includes a head formed on a handle and having a notch, a gear rotatably engaged in the head and having an opening for receiving fasteners, and a pair of pawls pivotally secured in the head and biased to engage with the gear and to control an active driving direction of the gear. One of the pawls may engage with the gear when the other pawl is engaged in the opening of the gear, and the other pawl is arranged to be engaged with the gear when the previous pawl is engaged in the opening of the gear, such that the gear may be continuously driven by the handle via the pawls.

4 Claims, 4 Drawing Sheets

RATCHET WRENCH

BACKGROUND OF THE INVENTION

1. Field of the Invention

The present invention relates to a wrench, and more particularly to a ratchet wrench.

2. Description of the Prior Art

Typical ratchet wrenches comprise a driving stem solidly secured thereto which may not be removed and changed with the other driving stems.

The present invention has arisen to mitigate and/or obviate the afore-described disadvantages of the conventional ratchet wrenches.

SUMMARY OF THE INVENTION

The primary objective of the present invention is to provide a ratchet wrench which may be used to drive various kinds of fasteners.

In accordance with one aspect of the invention, there is provided a ratchet wrench comprising a handle including a head having a notch, a gear rotatably engaged in the head and including an opening for receiving fasteners to be driven, a pair of pawls pivotally secured in the head, means for biasing the pawls to engage with the gear and to control an active driving direction of the gear. One of the pawls may engage with the gear when the other pawls is engaged in the opening of the gear such that the gear may be continuously driven by the handle via the pawls.

The gear includes a curved slot formed therein, the head includes a curved rib slidably engaged in the curved slot of the gear for rotatably securing the gear to the head. The first pawl is pivotally secured to the head at a pivot shaft, the second pawl is pivotally secured to the head at a pivot pin, the biasing means includes a spring engaged between the pawls for biasing the pawls to engage with the gear. The first pawl includes a first end having the pivot shaft provided therein and includes a second end for engaging with the spring, the second pawl includes a middle portion having the pivot shaft provided therein and includes an arm extended therefrom for engaging with the gear and includes an extension extended therefrom opposite to the arm for engaging with the spring.

One or more drive members are further provided for engaging with the fasteners to be driven, and means for detachably securing the drive member to the gear. The gear includes a peripheral fence for defining the opening of the gear and includes a peripheral channel formed in the peripheral fence of the gear, the detachably securing means includes a peripheral flange extended outward from the drive member and engaged into the peripheral channel of the gear for securing the drive member to the gear. The detachably securing means further includes means for coupling the drive member to the gear. The coupling means includes a spring engaged in the peripheral channel of the gear and engaged between the drive member and the gear for further securing the drive member to the gear. The drive member includes at least one recess formed therein, the spring includes at least one projection formed thereon for engaging into the recess of the drive member and for securing the drive member to the gear.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
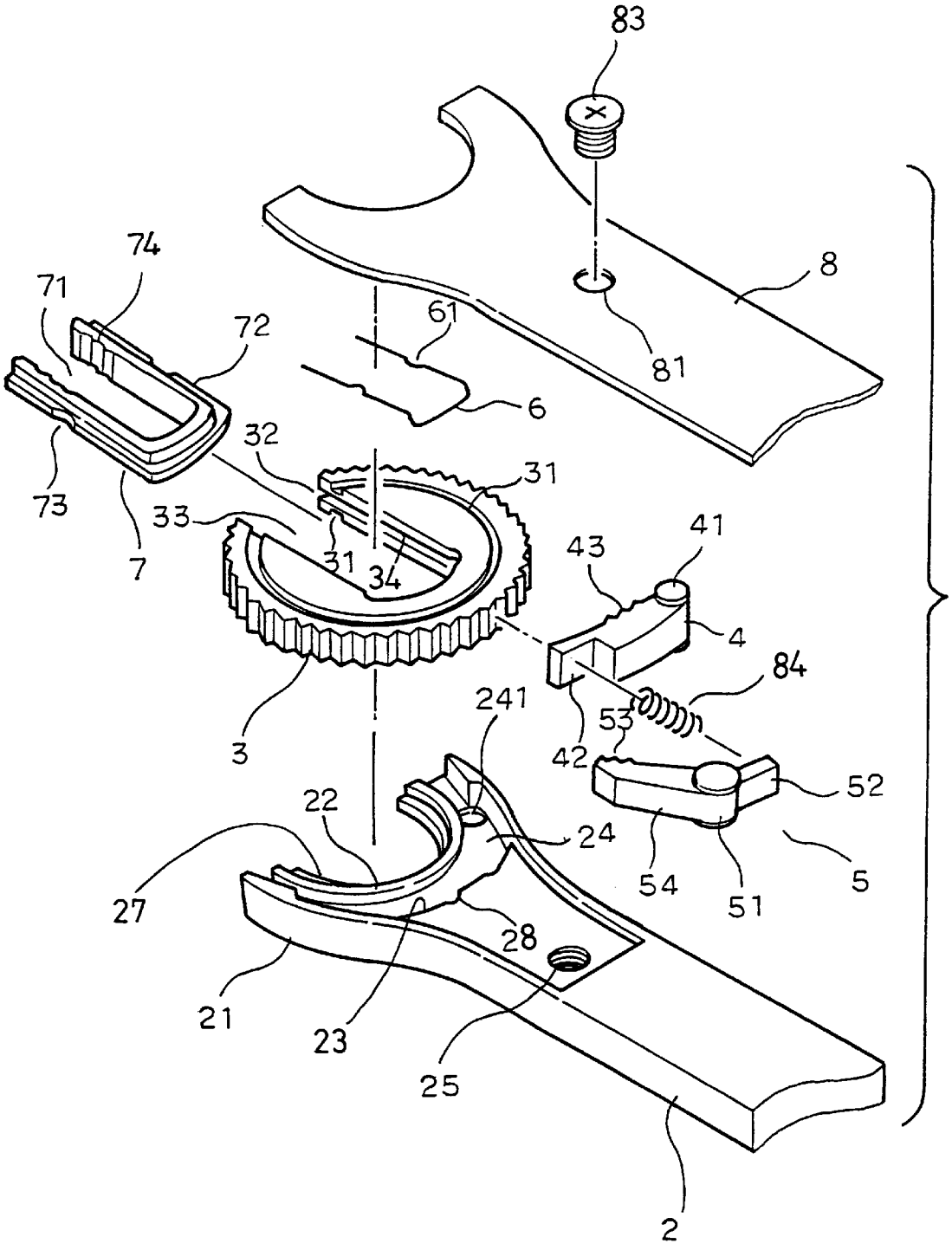
FIG. 1 is an exploded view of a ratchet wrench in accordance with the present invention.
Figure 2:
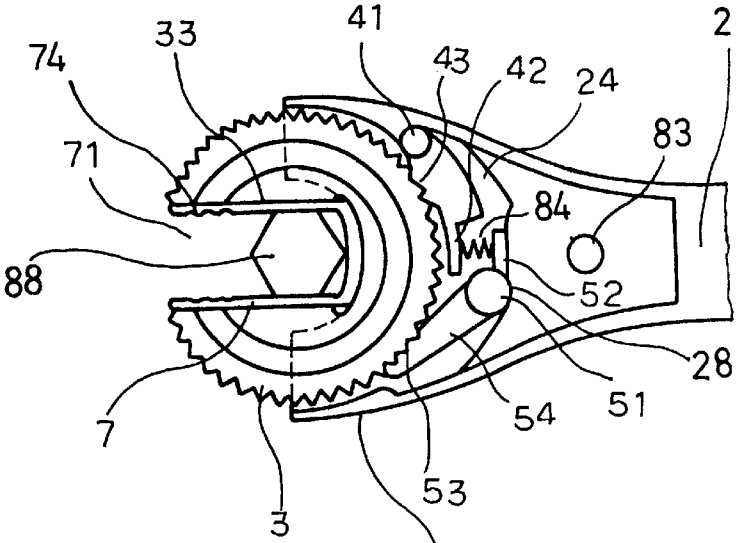
FIG. 2 is a plane view of the ratchet wrench, in which a cover is removed for showing the inner structure of the ratchet wrench.
Figure 3:
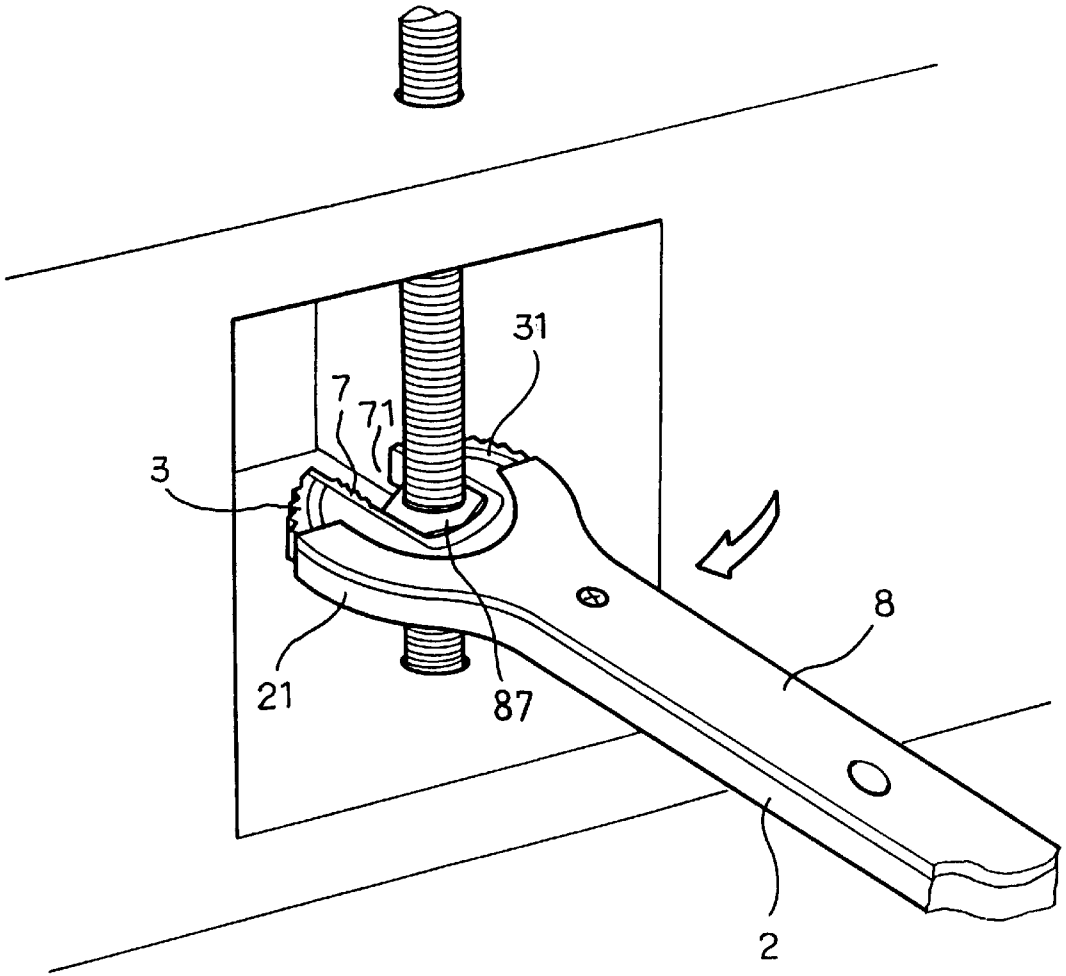
FIG. 3 is a perspective view illustrating the operation of the ratchet wrench.

Referring to the drawings, and initially to FIGS. 1–3, a ratchet wrench in accordance with the present invention comprises a handle 2 including a head 21 formed on one end thereof and including one or more screw holes 25 formed therein. The head 21 includes a notch 27 formed therein for receiving the fasteners 87, 88 (FIGS. 2, 3) and the like and includes a curved rib 22 formed thereon and includes a curved groove 24 formed beside the curved rib 22 and defined by the curved rib 22 and a wall 23, and includes one or more curved depressions 28 formed in the wall 23, and includes an orifice 241 formed therein and communicating with the curved groove 24.

Figure 4:
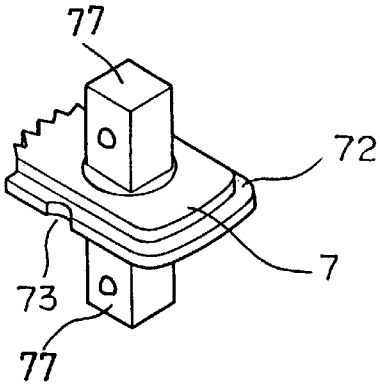
FIGS. 4 and 5 are perspective views illustrating two applications of the driving member.
Figure 5:
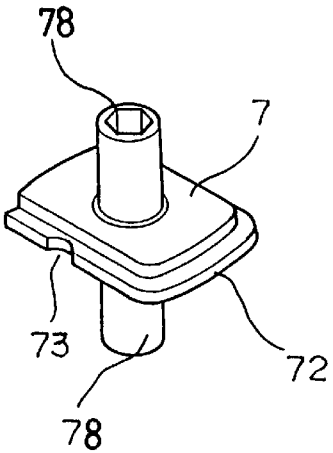
Figure 6:
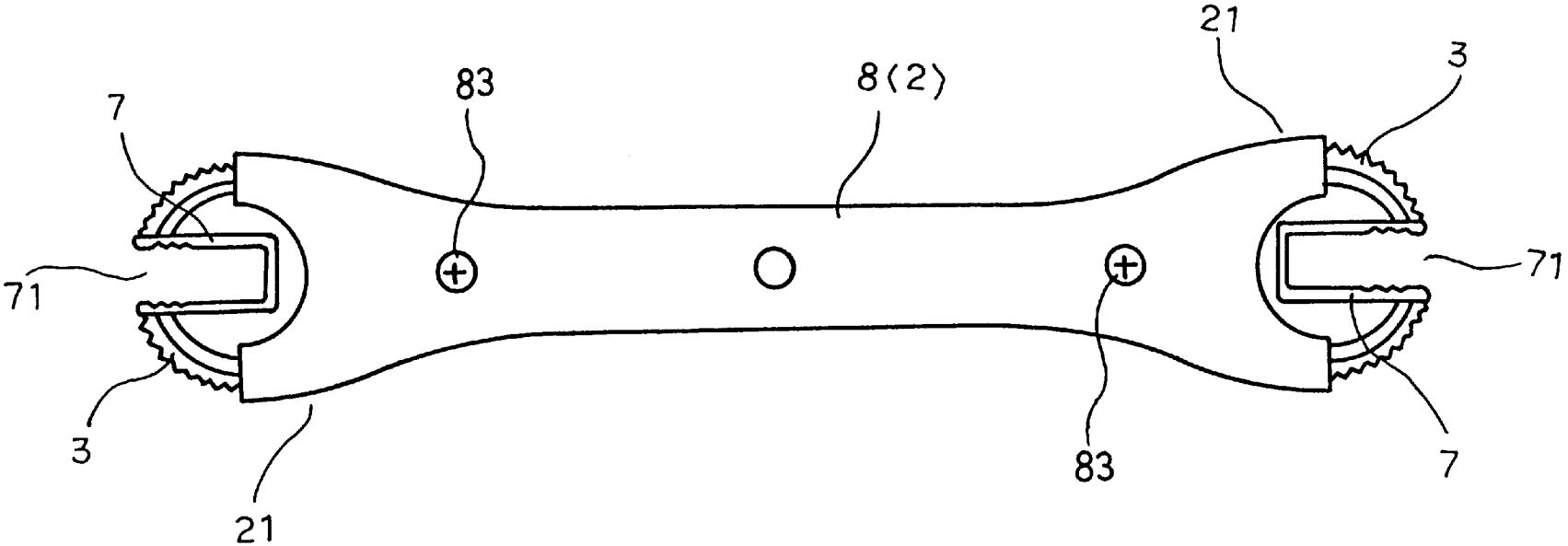
FIG. 6 is a plane view illustrating the other application of the ratchet wrench.

A gear 3 includes an opening 33 formed therein and communicating with the notch 27 of the head 21 of the handle 2 and defined by a U-shaped peripheral fence 32 for receiving the fasteners 87, 88 and the like. The gear 3 includes one or both sides each having a curved slot 31 formed therein for rotatably receiving the curved rib 22 of the head 21 of the ratchet wrench, and includes a peripheral channel 34 formed in the peripheral fence 32 of the gear 3. A U-shaped spring 6 is received in the peripheral channel 34 of the gear 3 and includes one or more projection 61 extended inward of the opening 33 of the gear 3. A drive member 7 includes an aperture 71 formed therein for receiving the fasteners 87, 88 (FIGS. 2, 3) and the like and includes a peripheral flange 72 extended outward therefrom for slidably engaging into the peripheral channel 34 of the gear 3 and includes one or more recesses 73 formed therein for receiving the projections 61 of the spring 6 which may resiliently securing the driving member 7 to the gear 3. The driving member 7 may include one or more driving stems 77 (FIG. 4) extended therefrom, or may include one or more sockets 78 (FIG. 5) extended therefrom for engaging with various kinds of fasteners or tool extensions. The handle 2 may include one or both ends thereof each having a gear 3 and a driving member 7 provided therein (FIG. 6).

A first pawl 4 includes a shaft 41 provided on one end thereof and rotatably engaged into the orifice 241 of the head 21 and includes one or more teeth 43 formed thereon for engaging with the gear 3 and includes the other end 42 for engaging with a spring 84. A second pawl 5 includes a pin 51 rotatably engaged into the curved depression 28 of the head 21 and includes an extension 52 extended from the pin 51 for engaging with the spring 84 and includes an arm 54 extended therefrom opposite to the extension 52 and having one or more teeth 53 formed thereon for engaging with the gear 3. The spring 84 is engaged between the other end 42 of the first pawl 4 and the extension 52 of the second pawl 5 for biasing the teeth 43, 53 of the pawls 4, 5 to engage with the gear 3. A cover 8 includes one or more holes 81 formed therein for receiving fasteners 83 which may secure the cover 8 to the handle 2.

In operation, as shown in FIG. 2, the teeth of the gear 3 may engage with the teeth 43, 53 of both of the pawls 4, 5 when the handle 2 is rotated clockwise, such that the gear 3 may be rotated clockwise by the handle 2. When the handle 2 is rotated counterclockwise, the pawls 4, 5 may be moved against the spring 84 such that the gear 3 will not be rotated counterclockwise by the handle 2, and such that the gear 3 may be driven clockwise by the handle 2 step by step. The gear 3 may be driven counterclockwise by the handle 2 when the handle 2 is disposed up-side-down.

It is to be noted that, due to the aperture 71 of the drive member 7, when the gear 3 is rotated for about 130 to 150 degrees, for example, clockwise relative to the handle 2, the teeth 43 of the pawl 4 will be received in the aperture 71 of the drive member 7 and may not be engaged with the teeth of the gear 3. At this moment, only the pawl 5 will engage with the gear 3 to actuate the gear 3. When the gear 3 is rotated for about 210 to 230 degrees, for example, clockwise relative to the handle 2, the teeth 53 of the pawl 5 will be received in the aperture 71 of the drive member 7 and may not be engaged with the teeth of the gear 3. At this moment, only the pawl 4 will engage with the gear 3 to actuate the gear 3. Accordingly, the two pawls 4, 5 are provided for engaging with and for driving the gear 3 separately when one of the pawls 4, 5 is engaged in the aperture 71 of the drive member 7, such that the gear 3 may be continuously driven by the handle 2.

It is further to be noted that, without the drive member 7, the fasteners may also be engaged in the opening 33 of the gear 3 and engaged with the peripheral fence 32 of the gear 3 and driven by the handle 2 via the gear 3. The engageable of the various kinds of drive members 7 allows the gear 3 and/or the drive member 7 of the ratchet wrench to drive various kinds of fasteners. The cover 8 may include a curved rib engaged into the curved slot 31 of the gear 3 for further stably and rotatably coupling the gear 3 to the handle 2. The cover 8 may further include two recesses formed therein for rotatably receiving the shaft 41 of the pawl 4 and the pin 51 of the pawl 5 respectively.

Accordingly, the ratchet wrench in accordance with the present invention may be used to drive various kinds of fasteners.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet wrench comprising:

a handle including a first end having a head provided therein, said head including a notch formed therein, a gear rotatably engaged in said head of said handle and including an opening formed therein for receiving fasteners to be driven, said gear including a peripheral fence for defining said opening of said gear and including a peripheral channel formed in said peripheral fence of said gear, a pair of pawls pivotally secured in said head of said handle, means for biasing said pawls to engage with said gear and to control an active driving direction of said gear, a first of said pawls being arranged to be engaged with said gear when a second of said pawls is engaged in said opening of said gear, and said second pawl being arranged to be engaged with said gear when said first pawl is engaged in said opening of said gear, for allowing said gear to be continuously driven by said handle via said pawls, at least one drive member for engaging with the fasteners to be driven, said at least one drive member including at least one recess formed therein, and means for detachably securing said at least one drive member to said gear, said detachably securing means including a peripheral flange extended outward from said at least one drive member and engaged into said peripheral channel of said sear for securing said at least one drive member to said gear, said detachably securing means including means for coupling said at least one drive member to said gear, said coupling means including a spring engaged in said peripheral channel of said gear and engaged between said at least one drive member and said gear for further securing said at least one drive member to said gear, said spring including at least one projection formed thereon for engaging into said at least one recess of said at least one drive member and for securing said at least one drive member to said gear.

2. The ratchet wrench according to claim 1, wherein said gear includes a curved slot formed therein, said head of said handle includes a curved rib slidably engaged in said curved slot of said gear for rotatably securing said gear to said head of said handle.

3. The ratchet wrench according to claim 1, wherein said first pawl is pivotally secured to said head of said handle at a pivot shaft, said second pawl is pivotally secured to said head of said handle at a pivot pin, said biasing means includes a spring engaged between said pawls for biasing said pawls to engage with said gear.

4. The ratchet wrench according to claim 3, wherein said first pawl includes a first end having said pivot shaft provided therein and includes a second end for engaging with said spring, said second pawl includes a middle portion having said pivot pin provided therein and includes an arm extended therefrom for engaging with said gear and includes an extension extended therefrom opposite to said arm for engaging with said spring.

* * * * *